United States Patent [19]

Eckhoff

[11] 4,191,796

[45] Mar. 4, 1980

[54] METHOD OF PREVENTING PEEL OF OLD PAINT

[76] Inventor: Paul S. Eckhoff, R.F.D. #1, Moor's Hill Rd., Syosset, N.Y. 11791

[21] Appl. No.: 953,737

[22] Filed: Oct. 23, 1978

[51] Int. Cl.[2] ..... B05D 1/36; B05D 7/00

[52] U.S. Cl. ..... 427/408; 428/511; 428/537; 428/423.7; 428/424.6; 428/424.8; 428/425.1

[58] Field of Search ..... 427/407 R, 408, 385 R, 427/393; 428/425, 511, 537; 260/22 TN, 23 TN, 29.2 TN

[56] References Cited

U.S. PATENT DOCUMENTS

| | | | |
|---|---|---|---|
| 3,012,984 | 8/1961 | Hudson | 428/425 |
| 3,180,753 | 4/1965 | Fritsch et al. | 427/408 |
| 3,549,404 | 12/1970 | Liberti et al. | 428/425 |
| 3,911,178 | 10/1975 | McDowell et al. | 428/425 |
| 3,919,145 | 11/1975 | Eckhoff | 260/23 TN |
| 4,108,811 | 8/1978 | Eckhoff | 260/22 TN |

*Primary Examiner*—Ronald H. Smith
*Assistant Examiner*—Sadie L. Childs
*Attorney, Agent, or Firm*—Robert H. Dewey

[57] ABSTRACT

A method for preventing the peeling of old paint from substrate when a latex paint is applied thereto comprising the step of first applying to the old paint a composition consisting essentially of an aqueous resin binder formed by blending (1) an aqueous alkaline emulsion of a polyurethane resin based on a drying oil and (2) an aqueous dispersion of a thermoplastic acrylic polymer.

1 Claim, No Drawings

METHOD OF PREVENTING PEEL OF OLD PAINT

BACKGROUND OF THE INVENTION

This invention relates to a method of preventing peeling of paint. In a particular aspect, this invention relates to a method of preventing peeling of old paint from a substrate when a latex paint is applied over the old paint.

It is common knowledge that, when a latex paint, i.e., a water-based paint, is applied over an old oil-based paint on a substrate, ultimately extensive areas of the old paint will peel leaving the substrate bare. This occurs most frequently when a wooden house, fence, etc. which has been painted one or more times with an oil-based paint is painted with a latex paint. Initially the results appear to be satisfactory, but ultimately adhesion of the first coat fails and the entire coating peels.

This event has previously been regarded as the result of poor adhesion of the first coat. However, this explanation fails in view of the fact that adhesion was satisfactory until the latex coat was applied. Regardless of the cause, it was discovered that the problem could be minimized by applying an oil-based primer over the old paint before applying the latex. However, this solution suffers from the disadvantage that the old paint and substrate must be completely dry and free from moisture before the primer is applied, which is often difficult to achieve, especially on outdoor surfaces. Also, the oil-based primer lacks all the advantages of the water-based latex. Accordingly, there is a need for a better method of preventing peeling of old paint after application of a latex paint thereto.

SUMMARY OF THE INVENTION

It is an object of this invention to provide an improved method of preventing the peeling of oil paint.

It is another object of this invention to provide an improved method of preventing the peeling of old paint from a substrate when a latex paint is applied over the old paint.

Other objects of this invention will be apparent to those skilled in the art from the description herein.

It is the discovery of this invention to provide a method for preventing the peeling of old paint from substrate when a latex paint is applied thereto comprising the step of first applying to the old paint a composition consisting essentially of an aqueous resin binder formed by blending (1) an aqueous alkaline emulsion of a polyurethane resin based on a drying oil and (2) an aqueous dispersion of a thermoplastic acrylic polymer. This composition is known as 200-S-X and will be so designated hereinafter.

DETAILED DISCUSSION

The product known as 200-S-X was disclosed by Paul S. Eckhoff in U.S. Pat. No. 4,108,811 which is incorporated herein by reference thereto. It is a clear, water-based emulsion and, therefore, can be conveniently applied, even over a wet substrate, whereas an oil-based primer can be applied only to a thoroughly dry surface. Also, since a water-based latex is to be applied over the 200-S-X coating in the practice of this invention, it can be applied as soon as the 200-S-X coating has dried to the point that it will not be physically damaged or displaced while the latex is being applied. A period of one hour is generally sufficient.

The 200-S-X need be applied only in a single coat but advantageously it should be of sufficient thickness to penetrate cracks and scales and generally provide continuous coverage of the old paint film.

The nature of the old paint is not critical. The method of the present invention can be practiced on any old paint which tends to peel after a latex paint is applied thereto. In general, it is old oil-based paint which exhibits this tendency. The term "old paint" is intended to mean a paint coating which has been on the substrate for a year or more. Generally, such a paint coating is not recoated until it shows signs of failure, such as cracking, etc. However, re-coating may be desirable at any time after application for decorative reasons. Hence, it is advantageous to practice the invention anytime the substrate is to be re-coated.

The nature of the latex paint to be applied over the 200-S-X coating is not critical and the practice of this invention is not limited to any particular latex. Latex paints formulated with styrene-butadiene copolymer, vinyl chloride polymer or copolymer, or an acrylic polymer or copolymer are effective in the method of the present invention.

Following is a typical preparation of 200-S-X. The total procedure involves preparation of an alkyd-modified polyurethane, the alkyd modifier therefor, then the formation of an emulsion of the polyurethane and a thermoplastic acrylic film-forming polymer. It is understood that the following preparation is merely typical and it is not intended that the invention be limited to the particular preparation herein described. It will be apparent to one skilled in the art that equivalent alternate raw materials and intermediates can be used and also that there can be considerable latitude in the quantities set forth.

Preparation of Alkyd Intermediate

In a suitable reactor, such as an alkyd reactor, heat soybean oil, 1256 lb, while sparging with nitrogen at 5 cubic feet per minute. Add pentaerythritol, 146 lb, at 215° F. and continue heating to 408° F. in one hour. At 408° F. add 91 g litharge slurried in a small amount of oil. Continue heating to 453° F., taking about one hour. At 453° F. add phthalic anhydride, 214 lb, and an anti-foam agent. The elapsed time to this point is about three hours. Cool to 400° F. and add ethylene glycol, 56 lb. After all the ethylene glycol has been added, heat to 430° F. and hold at 430° F. for approximately four hours, at which time the acid number will be approximately 6 to 7. Cool the batch to 300° F. and add xylol, 334 lb, to reduce the non-volatile content to 84%. Pass the solution through a filter press and pump to a steam-jacketed reactor for the next stage, i.e., the reaction of the alkyd intermediate with toluene diisocyanate.

Preparation of Alkyd-Modified Polyurethane

The conversion of the alkyd intermediate into an alkyd-modified polyurethane is carried out as follows. Charge 6609 lbs of the alkyd intermediate and 43.5 lb of xylol to a steam-jacketed reactor fitted with a reflux condenser and agitator. Use slow speed agitation (about 40 rpm). Begin heating the mixture of intermediate and xylol while adding 836 lb of toluene diisocyanate over a period of a half hour. Heat to 200° F. and maintain the temperature at 200° F. Cook to a viscosity of about 120 seconds as determined in a standard 10.65 mm Gardner viscosity vial, which requires about four hours. Commence cooling at the anticipated endpoint and pump in 96.5 pounds of methanol below the liquid level with the condenser on. Cool to 120° F., add 16.5 lb of a 38% solution of 1,10-phenanthroline and pump the mixture to storage.

Preparation of 200-S-X

A batch of the alkaline emulsion of polyurethane and latex is prepared as follows. Heat 450 lb of the alkyd-modified polyurethane resin solution (85% solids) to approximately 85° F. in a high-shear mixing vessel. Add 9 lbs of concentrated ammonium hydroxide slowly, with agitation. After the mixture becomes homogeneous, add 60 lbs of polyoxyethylated nonylphenol containing 65% ethylene oxide, then add gradually 4,737 lbs of an emulsion of a 100% thermoplastic acrylic resin having a solids content of 46% (a suitable acrylic emulsion is AQUAMAC 630 marketed by the Mc Whorter resin division of International Minerals and Chemicals. Observe the inversion from a "water-in-oil" state to the "oil-in-water" state. After inversion, continue agitation for at least ten minutes.

Water-resistant properties may be further enhanced by the addition of approximately 1.5% by weight, based on the total resin content, of a silicone polymer. Thus, in the foregoing preparation, there can be added 79 lbs of a 33% silicone resin dissolved in mineral spirits.

The invention will be better understood with reference to the following example. It is understood that the example is intended only for illustration and that the invention is not to be limited thereby.

EXAMPLE

A piece of siding was cut from an old building. The siding was covered with several layers of old paint, believed to have been oil-based. The siding was cut into several equal-sized panels. One panel was coated with 200-S-X and allowed to dry overnight. On the next day this panel and an untreated one were coated with a commercial latex emulsion paint. The two panels were mounted on a test fence and allowed to weather for twelve months. At the end of the test, the panel treated with 200-S-X was in good condition showing no tendency to peel. The other panel not treated with 200-S-X showed extensive peeling down to bare wood.

I claim:

1. A method for preventing the peeling of old paint from a wooden substrate when a latex paint is applied thereto comprising the step of first applying to the old paint a composition consisting essentially of an aqueous resin binder formed by blending (1) an aqueous alkaline emulsion of a polyurethane resin based on a drying oil and (2) an aqueous dispersion of a thermoplastic acrylic polymer.

* * * * *